US011413777B2

(12) United States Patent
Brellis et al.

(10) Patent No.: US 11,413,777 B2
(45) Date of Patent: Aug. 16, 2022

(54) RAZOR HANDLES

(71) Applicant: BIC-VIOLEX SA, Anixi (GR)

(72) Inventors: Christoforos-Athanasios Brellis, Neapoli (GR); Efstratios Christofidellis, Kifisia (GR); Argyro Kallivretaki, Kolonos (GR); Maria Petratou, Marousi (GR); Ioannis-Marios Psimadas, Vrilisia (GR); Dimitrios Nathanail, Athens (GR)

(73) Assignee: BIC Violex Single Member S.A., Anoixi (GR)

( * ) Notice: Subject to any disclaimer, the term of this patent is extended or adjusted under 35 U.S.C. 154(b) by 56 days.

(21) Appl. No.: 16/604,910

(22) PCT Filed: Apr. 11, 2018

(86) PCT No.: PCT/EP2018/059273

§ 371 (c)(1),
(2) Date: Oct. 11, 2019

(87) PCT Pub. No.: WO2018/189233

PCT Pub. Date: Oct. 18, 2018

(65) Prior Publication Data

US 2020/0398450 A1 Dec. 24, 2020

(30) Foreign Application Priority Data

Apr. 13, 2017 (EP) ..... 17166617

(51) Int. Cl.
*B26B 21/52* (2006.01)

(52) U.S. Cl.
CPC ..... *B26B 21/522* (2013.01); *B26B 21/521* (2013.01)

(58) Field of Classification Search
CPC ..... B26B 21/522; B26B 21/52; A46B 5/00; A46B 5/0037; A46B 5/0062
(Continued)

(56) References Cited

U.S. PATENT DOCUMENTS 2,053,258 A 9/1936 Axien
2,083,172 A 6/1937 Smith
(Continued)

FOREIGN PATENT DOCUMENTS

CN 1072628 A 6/1993
CN 1864947 A 11/2006
(Continued)

OTHER PUBLICATIONS

International Search Report and Written Opinion dated Jul. 6, 2018, in International Application No. PCT/EP2018/059273 (13 pages).
(Continued)

*Primary Examiner* — Nhat Chieu Q Do
(74) *Attorney, Agent, or Firm* — Bookoff McAndrews, PLLC

(57) ABSTRACT

A razor handle includes a handle body extending in a longitudinal direction. The handle body includes a first material having a front portion and a rear portion. The razor handle further includes a connecting portion for connection to a razor cartridge. The connecting portion extends from the front portion of the handle body. The handle body includes a supporting element which contributes to a relative movement between the front portion and the rear portion of the handle body.

15 Claims, 7 Drawing Sheets

(58) Field of Classification Search
USPC ..... 30/526–527
See application file for complete search history.

(56) References Cited

U.S. PATENT DOCUMENTS

| | | | | |
|---|---|---|---|---|
| 3,685,150 | A | 8/1972 | Risher | |
| 3,823,471 | A * | 7/1974 | Stone | B26B 21/06 30/526 |
| 4,879,811 | A | 11/1989 | Cooney | |
| 5,038,472 | A * | 8/1991 | Iderosa | B26B 21/521 30/527 |
| 5,046,249 | A | 9/1991 | Kawara et al. | |
| 5,054,154 | A * | 10/1991 | Schiffer | A46B 5/02 15/167.1 |
| 5,560,106 | A * | 10/1996 | Armbruster | B26B 21/225 30/526 |
| 5,678,316 | A * | 10/1997 | Althaus | B26B 21/522 30/340 |
| 5,771,591 | A * | 6/1998 | Armbruster | B26B 21/522 30/340 |
| 6,662,406 | B2 * | 12/2003 | Shonfeld | A01B 1/00 16/430 |
| 7,526,869 | B2 * | 5/2009 | Blatter | B26B 21/225 30/527 |
| 10,258,205 | B2 * | 4/2019 | Harrington | A46B 5/0095 |
| 2004/0177518 | A1 | 9/2004 | Leventhal | |
| 2004/0177519 | A1 * | 9/2004 | Tomassetti | B26B 21/446 30/527 |
| 2005/0172493 | A1 * | 8/2005 | Fischer | B26B 21/526 30/45 |
| 2007/0208354 | A1 * | 9/2007 | Barraclough | A45D 27/44 606/133 |
| 2011/0314677 | A1 * | 12/2011 | Meier | A46B 15/0002 30/41.8 |
| 2016/0029859 | A1 * | 2/2016 | Harrington | A46B 9/02 15/143.1 |
| 2019/0084169 | A1 * | 3/2019 | Bonk | B26B 21/521 |

FOREIGN PATENT DOCUMENTS

| | | | |
|---|---|---|---|
| EP | 2459353 | B1 | 3/2014 |
| EP | 2730378 | B1 | 2/2016 |
| EP | 3388210 | A1 | 10/2018 |
| FR | 2805197 | B1 | 7/2002 |
| WO | WO 2018189235 | A1 | 10/2018 |

OTHER PUBLICATIONS

Chinese Search Report dated Oct. 26, 2020 in CN201880013049.7.

* cited by examiner

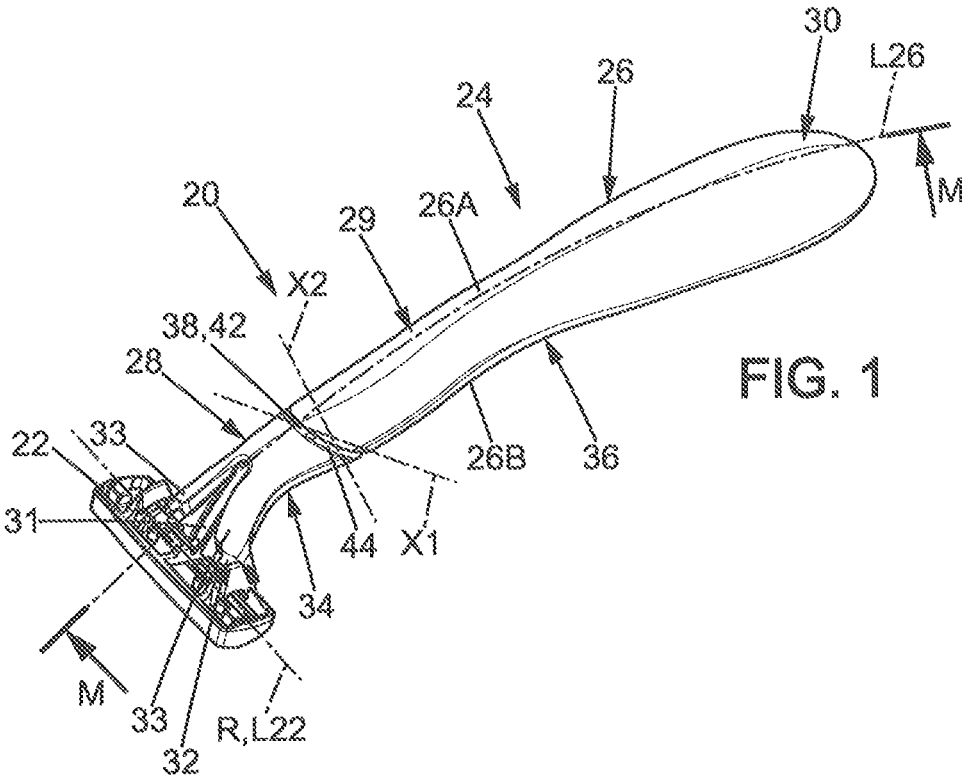
FIG. 1
FIG. 2
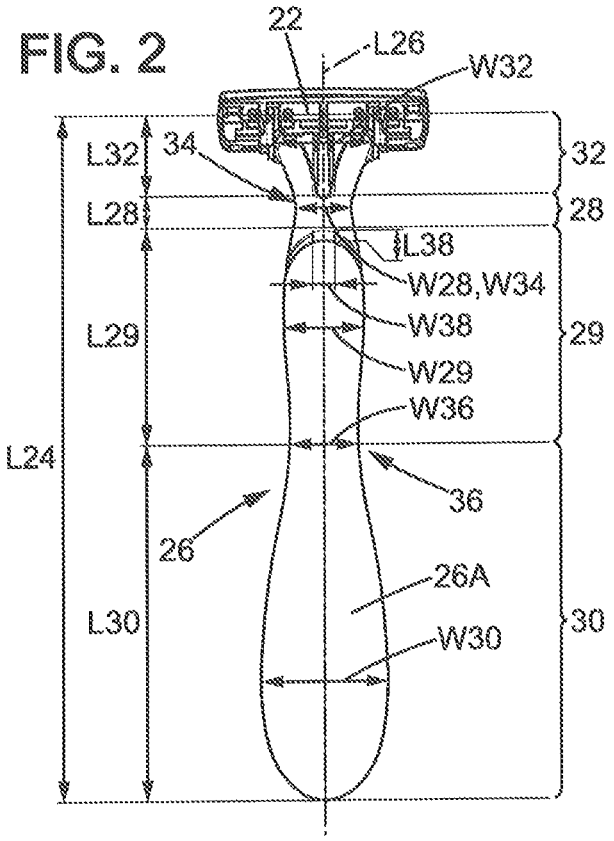
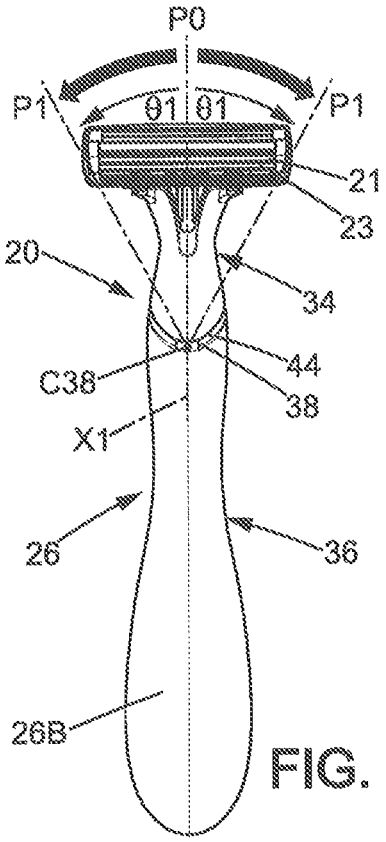
FIG. 3

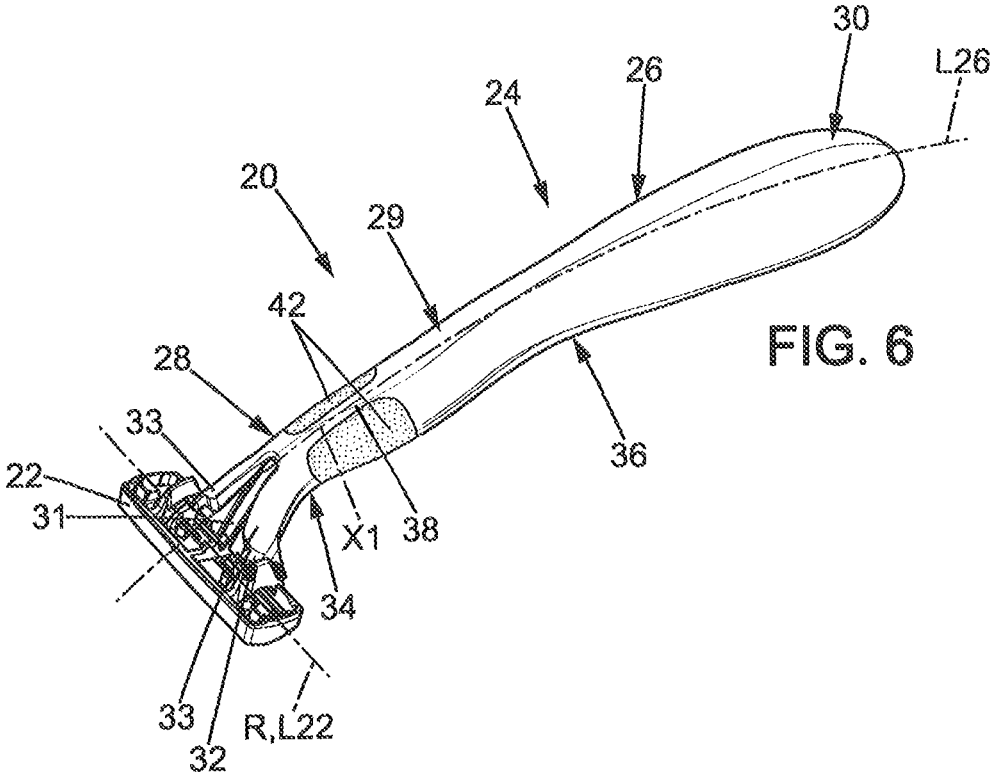
FIG. 6
FIG. 7
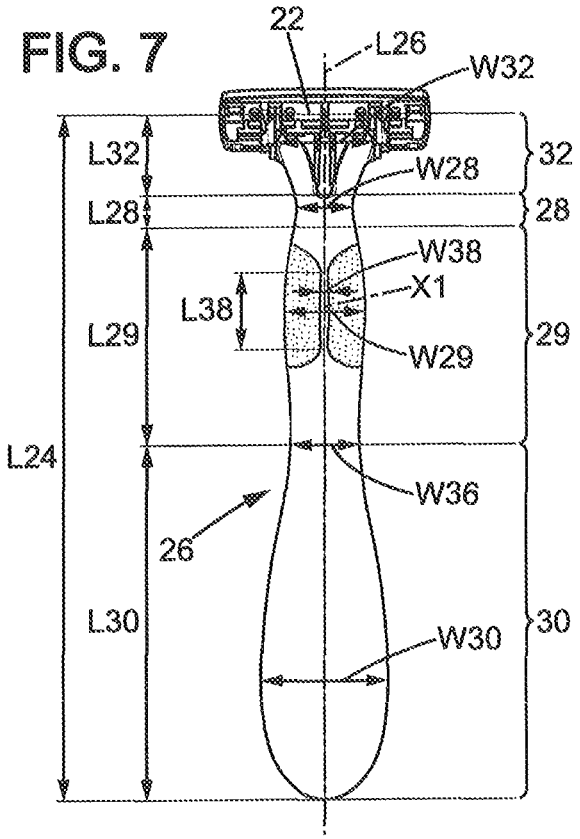
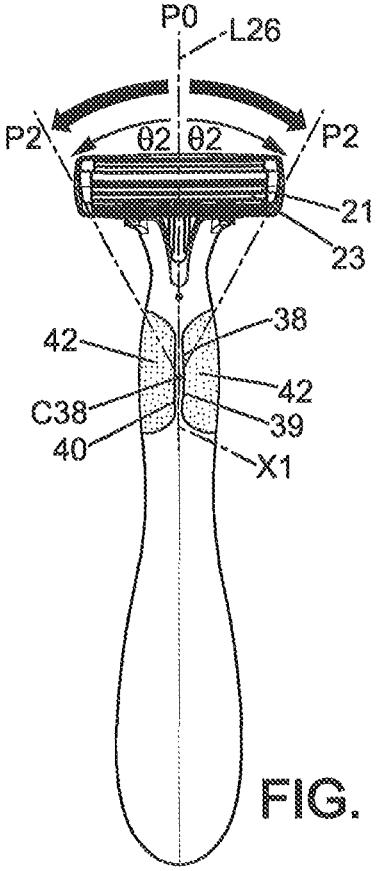
FIG. 8

RAZOR HANDLES

CROSS REFERENCE TO RELATED APPLICATIONS

This application is a National Stage application of International Application No. PCT/EP2018/059273, filed on Apr. 11, 2018, now published as WO 2018/189233 and which claims priority to European Application No. 17166617.5, filed Apr. 13, 2017.

FIELD

The disclosure relates to razor handles for shaving razors, the razor handles comprising an elastic part, and shaving razors comprising such razor handles.

DESCRIPTION OF RELATED ART

A razor handle commonly comprises an elongated handle body having a rear portion and a front portion. The razor handle further comprises a connecting portion, extending from the front portion, for connecting to a razor cartridge. Usually, the cartridge, when attached to the razor handle, pivots upwardly and downwardly and ensure a constant contact between the cartridge and the surface to shave. In order to improve the shaving, it may be useful for the razor handle to comprise a flexible feature.

Typically, a razor handle which is flexible allows a movement of the razor handle from top to bottom viewed from the side. However, such a razor handle does not allow for a safer and more comfortable shaving experience than other shaving razor without flexible feature, because of the lack of precision of the flexible feature. In addition, the movement provided by such a razor handle is only from top to bottom. Yet, it has been observed that a lateral movement of the razor handle can provide a better precision and efficiency to shaving.

In addition, it is known from FR2805197, a handle comprising a front and a rear portion, wherein the front portion is rotatable relative to the rear portion. The handle body further comprises an intermediate portion wherein the intermediate portion further comprises a second material, the second material being more elastic than the first material.

SUMMARY

According to the disclosure, a shaving razor comprising a razor handle improves the shaving experience by providing a lateral movement of the razor handle. The razor handle of the present description is also easily manufactured, because of its simple conception.

According to the disclosure, the razor handle comprises a handle body extending in a longitudinal direction, the handle body comprising a first material and having a front portion and a rear portion, the razor handle further comprising a connecting portion for connection to a razor cartridge, the connecting portion extending from the front portion of the handle body, wherein the handle body comprises at least one supporting element, the at least one supporting element contributing to a relative movement between the front portion and the rear portion of the handle body, the handle body further comprises a median plane extending along the longitudinal direction of the handle body, wherein the front portion is rotatable relative to the rear portion about a first axis, the first axis being located on the at least one supporting element, in the median plane, wherein the at least one supporting element extends longitudinally along the median plane of the handle body, wherein the handle body further comprises an intermediate portion between the front portion and the rear portion, wherein the at least one supporting element is located in the intermediate portion, wherein the intermediate portion further comprises a second material, the second material being more elastic than the first material, the at least one supporting element being made of the first material.

Such a configuration improves the shaving experience by adding a degree of freedom to the shaving razor for shaving while having a simple structure.

In further embodiments, one or more of the following features may be incorporated in the shaving razor of the disclosure, alone or in combination:

- The front portion is pivotable relative to the rear portion. The pivot movement between the front portion and the rear portion of the handle body allows a precise shaving.
- The handle body further comprises a median plane extending along the longitudinal direction of the handle body, wherein the front portion is rotatable relative to the rear portion about a first axis, the first axis being located on the at least one supporting element, in the median plane. This movement provides a lateral movement of the front portion relative to the rear portion. This lateral movement completes the usual pivot movement between the cartridge and the razor handle when connected together. The shaving razor is thus, a multidirectional pivoting shaving razor.
- The at least one supporting element extends longitudinally along the median plane of the handle body. The location of the supporting element may provide a symmetrical configuration allowing a lateral movement indifferently to one lateral side or to the other lateral side of the shaving razor.
- The handle body further comprises an intermediate portion between the front portion and the rear portion, wherein the at least one supporting element is located in the intermediate portion. The supporting element is therefore located in an area, between the rear portion and the front portion, but at a distance of the connecting portion allowing a precise using of the shaving razor.
- The intermediate portion further comprises a second material, the second material being more elastic than the first material. The second material, thanks to its elastic properties, contributes to the relative movement between the front portion and the rear portion of the handle body.
- The intermediate portion further comprises a gap. The gap allows for the relative movement between the front portion and the rear portion of the handle body.
- The gap is located on both sides of the at least one supporting element. Such a configuration may provide a symmetrical lateral movement indifferently to one lateral side or to the other lateral side of the shaving razor. In addition, the supporting element, combined with the gap located on the two lateral sides of the supporting element, allows a lateral movement of the handle body thanks to a simple configuration.
- The at least one supporting element is made of the second material.
- The at least one supporting element is made of the first material. In this configuration, the supporting element also strengthens the handle body.
- The second material is located on both sides of the at least one supporting element. The supporting element, combined with the two elastic lateral portions, may provide a symmetrical lateral movement indifferently to one lateral side or to the other lateral side of the shaving razor.

the front portion is rotatable relative to the rear portion about a second axis, the second axis being located in the median plane and passing through the at least one supporting element. This second axis allows the shaving razor to have a possible movement of the cartridge which can be completed according to several degrees of freedom.

The handle body comprises three supporting elements, each supporting element extending along a supporting element axis.

The handle body further comprising a top portion and a bottom portion wherein the first axis extends along an oblique line from the top portion to the bottom portion and wherein the handle body comprises two supporting elements, each supporting element extending perpendicularly to the first axis.

The rear portion further comprises the second material, the second material being more elastic than the first material whereby the rear portion is movable with respect to the front portion (28). Such a configuration provides a good handling of the razor handle, whatever the size of the hand. Therefore, the razor handle according to the disclosure is well suited to any hand size.

BRIEF DESCRIPTION OF THE DRAWINGS

Other characteristics and advantages of the disclosure will readily appear from the following description of embodiments, provided as non-limitative examples, in reference to the accompanying drawings.

FIG. 1 is a perspective top view of the shaving razor according to a first embodiment.

FIG. 2 is a top view of the shaving razor according to the first embodiment.

FIG. 3 is a bottom view of the shaving razor according to the first embodiment.

FIG. 6 is a perspective top view of the shaving razor according to a second embodiment.

FIG. 7 is a top view of the shaving razor according to the second embodiment.

FIG. 8 is a bottom view of the shaving razor according to the second embodiment.

DETAILED DESCRIPTION

Figure 5:
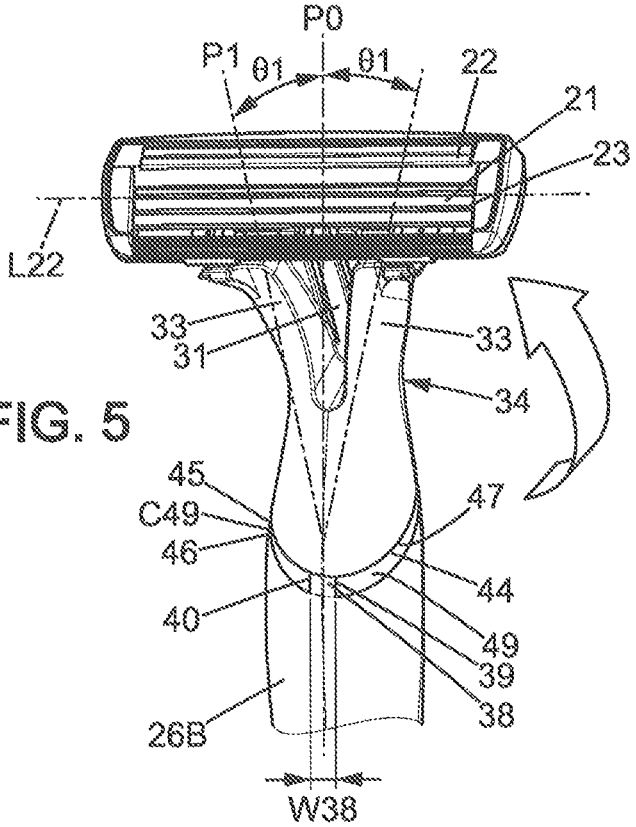
FIG. 5 is a perspective bottom view of the cartridge and the front portion of the handle body according to the first embodiment.
Figure 9:
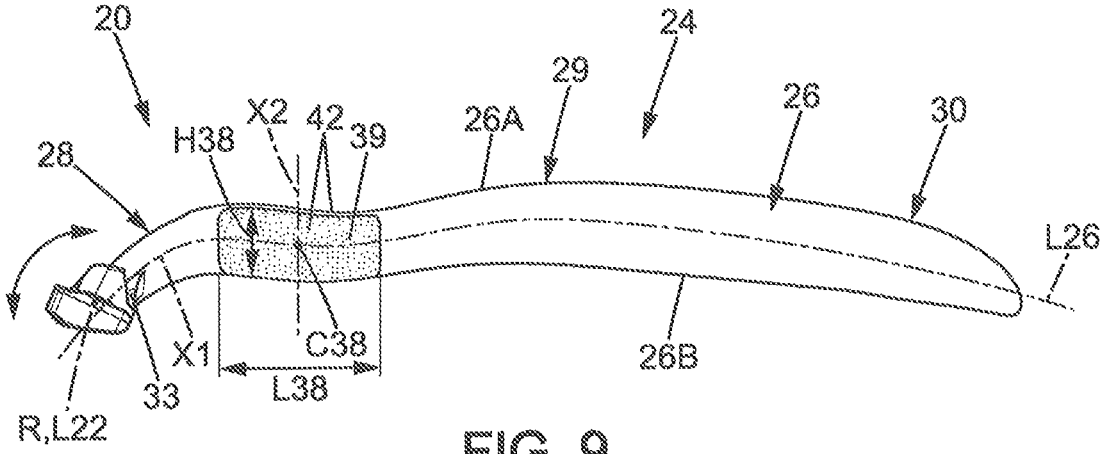
FIG. 9 is a side view of the shaving razor according to the second embodiment.
Figure 10:
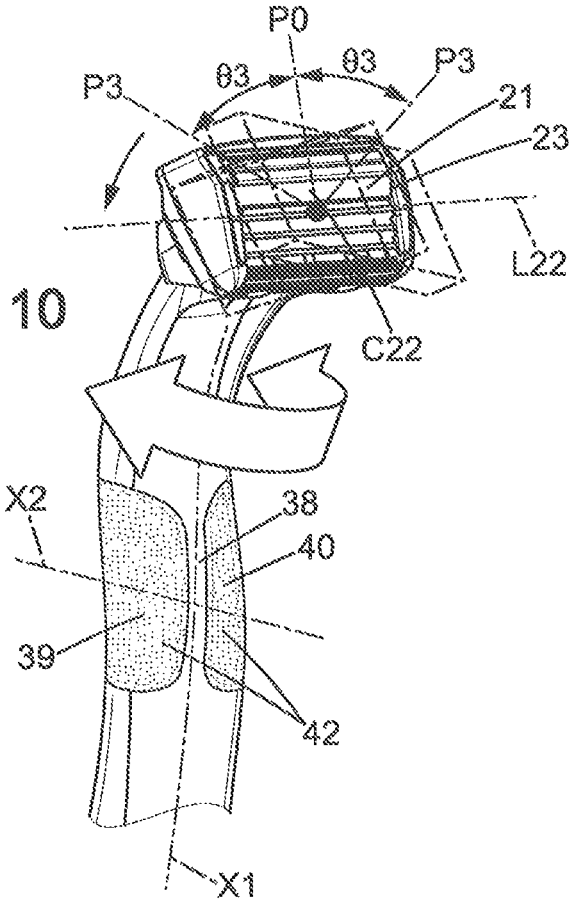
FIG. 10 is a perspective bottom view of the cartridge and the front portion of the handle body according to the second embodiment.

According to the disclosure, the shaving razor 20, as depicted in FIG. 1 or 6, comprises a cartridge 22 and a razor handle 24. FIGS. 5 and 10 show that cartridge 22 comprises blades 21, each blade 21 comprising a cutting edge 23. Each cutting edge 23 extends along the longitudinal direction L22 of the cartridge 22.

Moreover, the razor handle 24 may have a handle body 26. The handle body 26 may extend along a longitudinal direction L26. The handle body 26 may comprise, along the longitudinal direction L26, a front portion 28, an intermediate portion 29 and a rear portion 30. Furthermore, the razor handle 24 may have a connecting portion 32. The connecting portion 32 may extend from the front portion 28 and may be provided for the connection with the cartridge 22. More precisely, according to the disclosure, the cartridge 22 may be pivotally mounted on the razor handle 24 about a pivot axis R. The cartridge 22 can pivot with regard to the razor handle 26, as described for example in patent document EP 2 459 353 A1. The pivot axis R may be actually parallel to the longitudinal direction L22. Besides, the connecting portion 32 may comprise two elongated arms 33 extending from the front portion 28 in a direction away from the handle body 26 and a biasing member 31 which also extends from the front portion 28 in a direction away from the handle body 26 between the two said arms 33. The biasing member 31 can be formed as an elastic tongue 31, able to flex in a direction perpendicular to a plane defined by the two arms 33. Alternatively, the biasing member 31 may be a pusher to release the cartridge 22 from the razor handle 24. Furthermore, the connection portion 32 may comprise more than two arms or may be designed in any other techniques already known. In another embodiment (not shown), the cartridge 22 can be fixedly attached to the connecting portion 32 of the razor handle 24.

As it can be seen for example in FIGS. 1, 4, 5 and 9, the handle body 26 further comprises a top portion 26A and a bottom portion 26B. The top portion 26A and the bottom portion 26B result from the separation of the handle body 26 along a longitudinal plane T, which extends in the longitudinal direction L26 of the handle body 26. More precisely, the top portion 26A is visible in FIGS. 2 and 7 and the bottom portion 26B is visible in FIGS. 3 and 8. Cutting edges 23 of the blades 21 extend on the same side of the bottom portion 26B, and are also visible in bottom views of FIGS. 3 and 8.

Along the longitudinal direction L26 of the handle body 26, the lengths of the different portions are depicted in FIGS. 2 and 7, and are as following:

The length L28 of the front portion 28 may be comprised between 6 mm and 10 mm. For example, the length L28 may be about 8 mm.

The length L29 of the intermediate portion 29 may be comprised between 40 mm and 70 mm. For example, the length L29 may be about 50 mm.

The length L30 of the rear portion 30 may be comprised between 50 mm and 80 mm. For example, the length L30 may be about 65 mm.

The length L32 of the connecting portion 32 may be comprised between 13 mm and 20 mm. For example, the length L32 may be about 17 mm.

The length L24 of the handle 24 may be comprised between 110 mm and 170 mm. For example, the length L24 may be about 140 mm.

Furthermore, the handle body 26 may comprise a first neck 34 and a second neck 36, as shown in FIGS. 1 to 4 and in FIGS. 6 to 9. These first and second necks 34 and 36 may have a shape similar to narrowing of the razor handle 24. The first neck 34 may be located in the front portion 28. The first neck 34, at its smallest width W32, may be located in the front portion 28 at a distance comprised between 1.5 mm and 3 mm from the connecting portion 32. For example, the first neck 34 may be located in the front portion 28 at a distance about 2 mm from the connecting portion 32. The second neck 36 may lie between the intermediate portion 29 and the rear portion 30. According to this embodiment, the second neck 36 represents the limit area between the intermediate portion 29 and the rear portion 30. The second neck 36, at its smallest width W36, may be located at a distance comprised between 40 mm to 60 mm from the front portion 28. For example, the second neck 36 may be located at a distance 51 mm from the front portion 28.

The first and the second necks 34 and 36 allow a good handling of the handle body 26 by a user.

The handle body 26 may have only one neck, or more than two necks. The handle body 26 may have no neck.

Therefore, according to the disclosure, the handle body 26 may not have a constant width along the longitudinal direction L26. FIGS. 2 and 7 show different widths of the handle body 26, at the largest and the smallest values. The values of the different widths are measured in the transversal plane T, and are as following:

The width W28 of the front portion 28 may be comprised between 8.5 mm and 12.5 mm. For example, the width W28 may be about 10.5 mm.

The width W29 of the intermediate portion 29 may be comprised between 14 mm and 22 mm. For example, the width W29 may be about 18 mm.

The width W34 of the first neck 34 may be comprised between 8.5 mm and 12.5 mm. For example, the width W34 may be about 10.5 mm.

The width W36 of the second neck 36 may be comprised between 9 mm and 14 mm. For example, the width W36 may be about 11.5 mm.

The width W30 of the rear portion 30 may be comprised between 24 mm and 36 mm. For example, the width W30 may be about 30 mm.

Furthermore, according to the shaving razor 20 of the description, the intermediate portion 29 may comprise a supporting element 38. The supporting element 38 can extend along the longitudinal direction L26 of the handle body 26. The supporting element 38 may have two lateral sides, which are a first lateral side 39 and a second lateral side 40. In addition, the supporting element 38 may be continuous with the intermediate portion 29 along the longitudinal direction L26. More precisely, the supporting element 38 may be located in the median plane M of the handle body 26. The width W38 of the supporting element 38, measured perpendicularly to the longitudinal direction L26, and shown in FIG. 2 or 7, may be comprised between 0.3 mm and 3 mm. For example, the width W38 of the supporting element 38 may be about 1 mm. The length L38 of the supporting element 38, measured along the longitudinal direction L26, and shown in FIG. 2 or 7, may be comprised between 20 mm and 30 mm. For example, the length L38 of the supporting element 38 may be about 24 mm. The height H38 of the supporting element 38, taken from the top portion 26A to the bottom portion 26B and depicted in FIGS. 4 and 9 may be comprised between 6 mm and 12 mm. For example, the height H38 of the supporting element 38 may be about 8 mm. Actually, the outer shape of the supporting element 38 may follow the overall outer shape of the handle body 26. The supporting element 38 may not form a growth or other type of protrusion regarding the general shape of the handle body 26. It is therefore not possible to identify, from the general shape of the handle body 26, the correct location of the supporting element 38 in the handle body 26.

The handle body 26 further comprises an elastic portion 42. The elastic portion 42 may be made of a second material which is more elastic than a first material of which the rest of the handle body 26 is made. For example, the first material may be made of plastic. In another example, the second material may be a rubber. This second material, in addition to its elastic properties has the advantage to form a grip finger area for a user, allowing a good handling of the handle body 26. Besides, the second material works as suspension, which absorbs the force applied by a user on the elastic portion 42. The first and/or the second material can also be perfumed, which increases the perception of wellness and the feeling of an efficient and clean shaving.

The handle body 26, thanks to its elastic properties, may be movable between a rest position P0 and an extended position P1, P2 or P3. The rest position P0 may be illustrated for example in FIG. 3 or 8, and may be similar whatever the embodiment of the disclosure. From the rest position P0, the front portion 28 of the handle body 26 can move relative to the rear portion 30 until an extended position P1, P2 or P3. However, the handle body 26 always return to the rest position P0 when it is not subjected to stresses. The movement of the handle body 26 is different according to the embodiment in question and is described hereafter.

According to a first embodiment of the shaving razor 20 of the disclosure, depicted in FIGS. 1 to 5, the supporting element 38 and the elastic portion 42 may form the same element. In other words, the supporting element 38 may be an elastic portion 42. In this first embodiment, as depicted for instance in FIG. 5, the supporting element 38 may have a width W38 comprised between 3 mm and 5 mm, and a length L38 comprised between 5 mm and 20 mm. The height H38 of the supporting element 38, depicted in FIG. 4 may be comprised between 0.5 mm and 3 mm. For example, the height H38 of the supporting element 38 may be about 1 mm.

Figure 4:
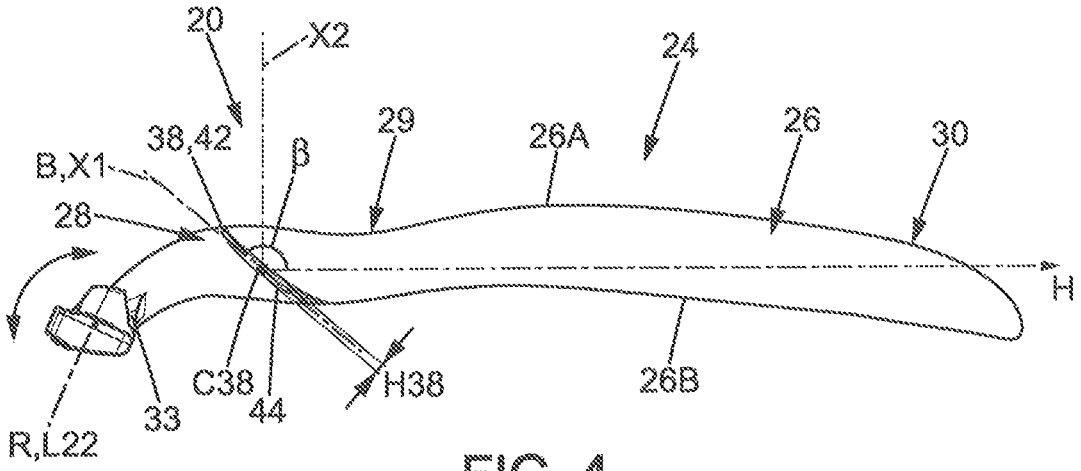
FIG. 4 is a side view of the shaving razor according to the first embodiment.

FIGS. 1 to 5 also show a gap 44 located on both sides 39 and 40 of the supporting element 38. The gap 44 may be similar to a notch made in the handle body 26. The gap 44 may separate the intermediate portion 29 in two parts. These two parts are linked together by the supporting element 38. These two parts may each comprise a free end and an outer edge. A first outer edge 45 may be located on the side of the front portion 28 and a second outer edge 46 may be located on the side of the rear portion 30. Likewise, a first free end 47 may be located on the side of the front portion 28 and a second free end 48 may be located on the side of the rear portion 30. The first and the second free ends 47 and 48 may be facing each other. Besides, in the rest position P0 of the handle body, the first free end 47 and the second free end 48 may be parallel to each other and may be spaced of a distance which corresponds to the width W38 of the supporting element 38. Moreover, FIG. 4 shows the gap 44 and the supporting element 38 may be disposed along an oblique line B transverse to the longitudinal direction L26, when viewed from the side. Thus, the gap 44 may pass through the handle body 26 from the top portion 26A to the bottom portion 26B. In addition, the oblique line B may define a first axis X1, the first axis X1 being placed in the median plane M of the handle body 26 and passing by the center point C38 of the supporting element 38. According to a horizontal axis H passing by the center point C38, the oblique line B forms an angle β with the horizontal axis H. Because of its elastic properties, the supporting element 38 allows the handle body 26 to move around the first axis X1.

FIG. 5 shows the movement of the front portion 28 relative to the rear portion 30 about the second axis X2. The second axis X2 passes by the supporting element 38, and is located in the median plane M while being perpendicular to the longitudinal plane T. The front portion 28 pivots about the second axis X2 from the rest position P0 to an extended position P1. The rest position P0 and the extended position P1 are separated by an angle θ1. The angle θ1 may be comprised between 2 and 15 degrees. For example, the angle θ1 may be about 7 degrees. The extended position P1 corresponds to a displacement of the front portion 28 with regard to the rear portion 30, outside the median plane M. The extended position P1 is limited by the dimension of the gap 44. Indeed, in the present embodiment as depicted in FIG. 5, the first edge 45 contacts the second edge 46 in a contacting point C49. In other embodiments, according to the dimensions of the supporting element 38, the contacting point C49 can be located on the second free end 49. Therefore, the extended position P1 that can be obtained by the handle body 26 is a function of dimensions of the gap 44 and the supporting element 38.

According to a second embodiment of the shaving razor of the disclosure, depicted in FIGS. 6 to 10, the intermediate portion 29 may comprise a supporting element 38 and an elastic portion 42 which are distinct from each other.

In this second embodiment, as depicted for instance in FIG. 8, the supporting element 38 may have a width W38 comprised between 0.3 mm and 3 mm. The width W38 may be constant according the length L38. The length L38, representing the part of the supporting element 38 with the constant width W38 may be comprised between 19 mm and 29 mm. The height H38 of the supporting element 38, depicted in FIG. 9 may be comprised between 6 mm and 12 mm. For example, the height H38 of the supporting element 38 may be about 8 mm. The height is measured between the top portion 26A and the bottom portion 26B, through the handle body 26.

As depicted in FIGS. 6, 7 and 8, the elastic portion 42 may be located on both sides 39 and 40 of the supporting element 38. Actually, the supporting element 38 separates the elastic portion 42 in two parts along the longitudinal direction L26. The outer shape of the elastic portion 42 follows the general shape of the handle body 26. In other words, the elastic portion 42 is forming the handle body 26 around the supporting element 38. Thus, obtaining a general shape of the handle body 26 without any protrusion or increasing the diameter of the handle body 26 since the elastic portion 42 is not wrapped around solid plastic but is an integral part of the razor handle 24. It is therefore not possible to identify, from the general shape of the handle body 26, the location of the elastic portion 42 in the handle body 26.

FIG. 8 shows the movement of the front portion 28 relative to the rear portion 30 about a second axis X2. The front portion 28 pivots about the second axis X2 from the rest position P0 to an extended position P2. The second axis X2 is located in the median plane M and is perpendicular to the longitudinal plane T. The second axis X2 crosses the supporting element 38 in its center point C38. The rest position P0 and the extended position P2 are separated by an angle θ2 taken about the second axis X2. The range of the angle θ2 is between 0 and 60 degrees. For example, the angle θ2 is about 20 degrees.

FIG. 10 shows the movement of the front portion 28 relative to the rear portion 30 about the first axis X1. According to this second embodiment, the first axis X1 is located on the supporting element 38, in the median plane M. Besides, the first axis X1 extends along the longitudinal direction L26 of the handle body 26. The front portion 28 pivots about the first axis X1, compared with the rear portion 30. As a result, when the cartridge 22 is attached to the razor handle 24, the cartridge 22 pivots about the first axis X1. The pivot movement of the cartridge 22 itself is depicted by the center point C22 of the cartridge 22. The first axis X1 passes by the center point C22. The cartridge 22 can pivot from the rest position P0 to an extended position P3. The angle θ3 from the rest position P0 and the extended position P3 is comprised between 0 and 80. Regarding the intermediate portion 29, such a movement leads to a torsion movement of the intermediate portion 29, about the first axis X1.

Still according to the second embodiment, in addition to the movements described above, a complementary movement can be a combined movement resulting of the movement around the second axis X2 and the movement around the first axis X1. The resulting movement is thus multidirectional.

Figure 11:
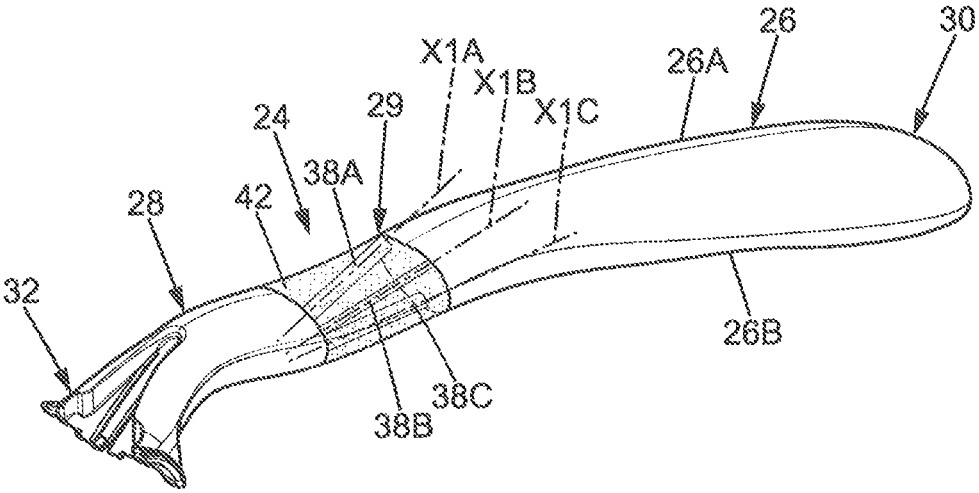
FIG. 11 is a perspective side view of the razor handle according to a third embodiment.
Figure 12:
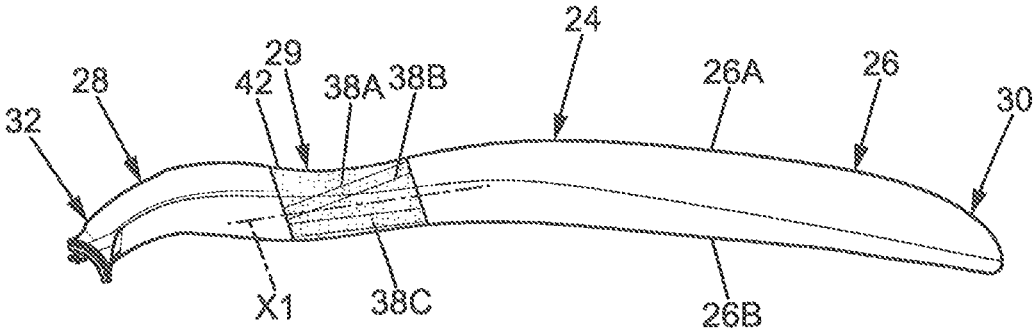
FIG. 12 is a side view of the razor handle according to the third embodiment.

A third embodiment is now described and depicted in FIGS. 11 and 12. The third embodiment is almost similar to the second embodiment, but the handle body 26 may comprise three supporting elements 38A, 38B and 38C. Each of the three supporting elements 38A, 38B and 38C may extend along a supporting element axis X1A, X1B and X1C.

Figure 13:
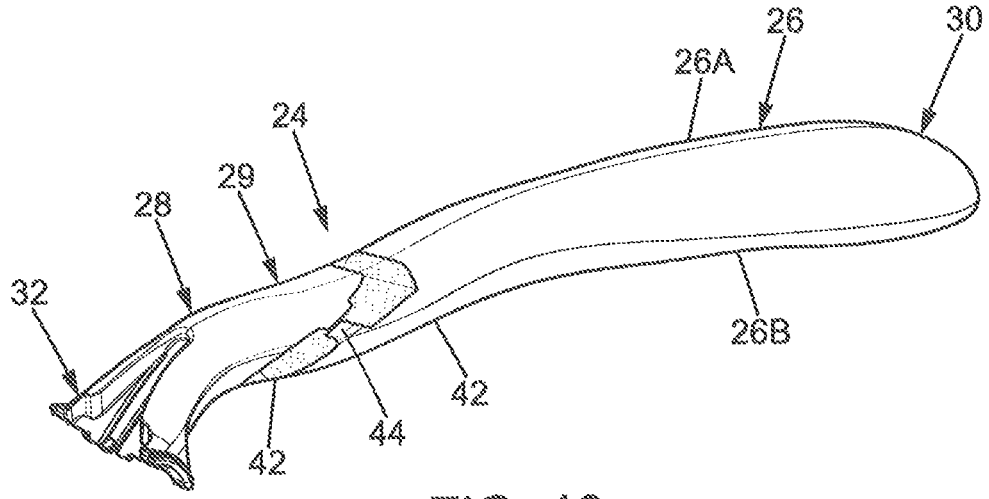
FIG. 13 is a perspective side view of the razor handle according to a fourth embodiment.
Figure 14:
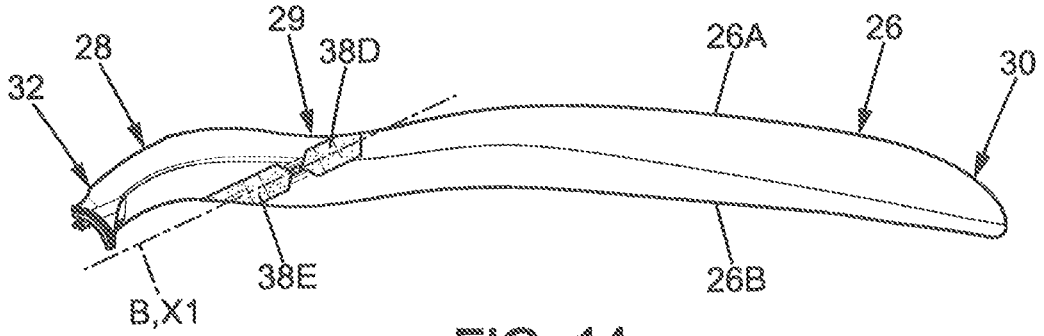
FIG. 14 is a side view of the razor handle according to the fourth embodiment.
Figure 15:
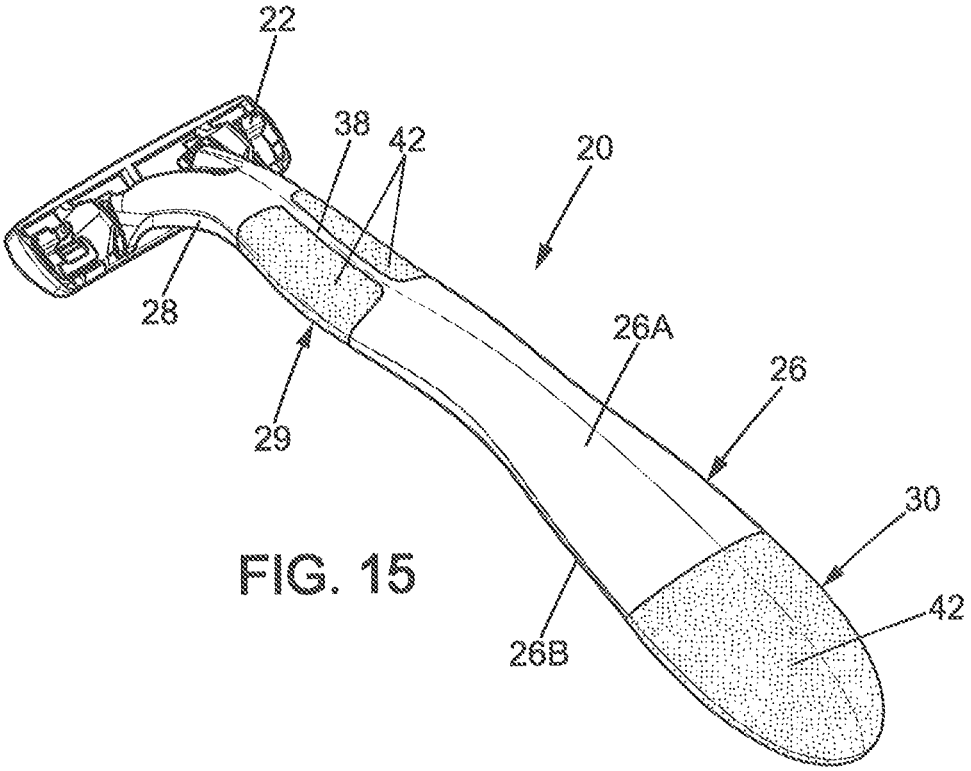
FIG. 15 is a perspective view of the shaving razor according to another embodiment.

According to a fourth embodiment, depicted in FIGS. 13 and 14, the handle body 26 may comprise two supporting elements 38D and 38E. The supporting elements 38D and 38E may be made of the first material. A gap 44 may be located on both sides of the supporting elements 38D and 38E. In addition an elastic portion 42, made of the second material, may surround the supporting elements 38D and 38E. The supporting elements 38D and 38E extend perpendicularly to the first axis X1. As described in the first embodiment, the first axis X1 extends along an oblique line B. According to another embodiment, depicted in FIG. 15, the handle body 26 may also have an elastic portion 42, located at the rear portion 30. Therefore, the rear portion 30 may be movable with respect to the front portion 28.

In all embodiments the supporting elements may be adapted according for example to the shape and design of the handle, a person skilled in the art, based on the present disclosure would adapt said supporting elements to the handle. In all embodiments, the supporting elements may be made of any suitable material such as plastic, rubber with different mechanical characteristics than the flexible portion (s), or metal.

Although the preceding description has been described herein with reference to particular means, materials and embodiments, it is not intended to be limited to the particulars disclosed herein; rather, it extends to all functionally equivalent structures, methods and uses, such as are within the scope of the appended claims.

The invention claimed is:

1. A razor comprising:

a razor cartridge comprising at least one blade comprising a cutting edge; and a razor handle comprising:

a symmetrical handle body being formed from a first material and extending in a longitudinal direction between a front portion and an opposing rear portion wherein the front portion is operatively connected to the razor cartridge;

the handle body including a median plane extending along the longitudinal direction of the handle body and from the front portion toward the opposing rear portion such that the median plane bisects the handle body into a first lateral side and a second lateral side, wherein the median plane is normal to an axis extending along the cutting edge of the at least one blade of the razor when the razor is in a resting position, and the handle body also having an intermediate portion positioned between the front portion and the rear portion;

the intermediate portion including at least one supporting element, the at least one supporting element extending longitudinally along the median plane of the handle body and having an outer surface that is a continuation of an outer surface of the intermediate portion along the longitudinal direction;

the intermediate portion including two elastic areas, the two elastic areas each being formed from a second material that is different from the first material and each being disposed on either side of the at least one supporting element about the median plane, wherein a first elastic area of the two elastic areas is disposed only on the first lateral side, and wherein a second elastic area of the two elastic areas is disposed only on the second lateral side, wherein the first elastic area and the second elastic area are elastic members, wherein the front portion, the intermediate portion, and the rear portion of the handle body form a continuous outer surface, wherein a circumference of the front portion about a longitudinal axis of the handle body is less than a greatest circumference of the intermediate portion of the handle body about the longitudinal axis of the handle body, and wherein a circumference of the rear portion about the longitudinal axis of the handle body is less than the greatest circumference of the intermediate portion of the handle body about the longitudinal axis of the handle body.

2. The razor according to claim 1, wherein the front portion is pivotable relative to the rear portion.

3. The razor according to claim 1, wherein the second material contains characteristics that allow the second material to have more elasticity than the first material.

4. The razor according to claim 1, wherein the at least one supporting element is formed from the first material.

5. The razor according to claim 1, wherein the at least one supporting element is formed from a second material, the second material contains characteristics that allow the second material to have more elasticity than the first material.

6. The razor according to claim 1, wherein the at least one supporting element extends longitudinally along the median plane of the handle body and defines a supporting element axis, the front portion being rotatable relative to the rear portion about a first axis, the first axis being located along the supporting element axis.

7. The razor according to claim 1, wherein the intermediate portion does not protrude relative to the continuous outer surface of the handle body.

8. The razor according to claim 1, wherein the elastic areas are not wrapped around the handle body.

9. The razor according to claim 1, wherein the at least one supporting element forms a living hinge between the front portion and the rear portion.

10. The razor according to claim 1, wherein the at least one supporting element is a narrowed portion of the handle body relative to the front portion and the opposing rear portion.

11. The razor according to claim 10, wherein each of the two elastic areas directly contacts the front portion of the handle body, the opposing rear portion of the handle body, and the at least one supporting element.

12. The razor according to claim 10, wherein the two elastic areas are not in direct contact with one another.

13. The razor according to claim 1, wherein the elastic areas extend only partially around a circumference of the handle body.

14. A razor handle configured to be connected to a razor cartridge comprising:

a symmetrical handle body being formed from a first material and extending in a longitudinal direction between a front portion and an opposing rear portion wherein the front portion is operatively connectable to the razor cartridge comprising at least one blade having a cutting edge;

the handle body including a connecting portion extending from the front portion and configured to connect to the cartridge to secure the cartridge to the handle body;

the handle body including a median plane extending along the longitudinal direction of the handle body and having an intermediate portion positioned between the front portion and the rear portion, wherein the median plane is normal to an axis along the cutting edge of the at least one blade of the razor cartridge when the razor handle is in a resting position;

the intermediate portion including at least one supporting element, the at least one supporting element extending longitudinally along the median plane of the handle body and having an outer surface that is a continuation of an outer surface of the intermediate portion along the longitudinal direction;

the intermediate portion including elastic areas, the elastic areas being formed from a second material that is different from the first material and each being disposed on either side of the at least one supporting element about the median plane, wherein the handle body is more flexible in a lateral side-to-side direction that is perpendicular to a front-rear direction of the handle body, wherein the front-rear direction extends from the front portion to the rear portion of the handle body, wherein the elastic areas are elastic members, wherein the elastic areas do not protrude from an outer surface of the handle body, wherein a thickness of the front portion is less than a greatest thickness of the intermediate portion of the handle body, and wherein a thickness of the rear portion is less than the greatest thickness of the intermediate portion of the handle body, and wherein the connecting portion includes two arms extending from the front portion and an elastic tongue configured to flex in a direction perpendicular to a plane defined by the two arms where the razor cartridge is configured to pivot relative to the handle body when secured to the handle body.

15. A razor comprising:

a razor cartridge comprising at least one blade comprising a cutting edge; and a razor handle comprising:

a symmetrical handle body being formed from a first material and extending in a longitudinal direction between a front portion and an opposing rear portion wherein the front portion is operatively connected to the razor cartridge;

the handle body including a median plane extending along the longitudinal direction of the handle body and from the front portion toward the opposing rear portion, wherein the median plane is normal to an axis along the cutting edge of the at least one blade of the razor cartridge, such that the median plane bisects the handle body into a first lateral side and a second lateral side, and the handle body also having an intermediate portion positioned between the front portion and the rear portion;

the intermediate portion including at least one supporting element that is a narrowed portion of the handle body relative to the front portion and the opposing rear portion of the handle body, the at least one supporting element extending longitudinally along the median plane of the handle body and having an outer surface that is a continuation of an outer surface of the intermediate portion along the longitudinal direction;

the intermediate portion including two elastic areas, the two elastic areas being formed from a second material that is different from the first material and each being disposed on either side of the at least one supporting element about the median plane, wherein a first elastic area of the two elastic areas is disposed only on the first lateral side, and wherein a second elastic area of the two elastic areas is disposed only on the second lateral side, wherein the handle body is more flexible in a lateral side-to-side direction that is perpendicular to a front-rear direction of the handle body, wherein the front-rear direction extends from the front portion to the rear portion of the handle body, wherein the first elastic area and the second elastic area are elastic members, wherein each of the two elastic areas directly contacts the front portion of the handle body, the opposing rear portion of the handle body, and the at least one supporting element, wherein a surface perimeter of the front portion about a longitudinal axis of the handle body is less than a greatest surface perimeter of the intermediate portion of the handle body about the longitudinal axis of the handle body, and wherein a surface perimeter of the rear portion about the longitudinal axis of the handle body is less than the greatest surface perimeter of the intermediate portion of the handle body about the longitudinal axis of the handle body.

* * * * *